US012251609B2

(12) United States Patent
Marvin

(10) Patent No.: US 12,251,609 B2
(45) Date of Patent: Mar. 18, 2025

(54) BAG TOSS GAME PROJECTILE BAG

(71) Applicant: Elakai Ltd., Coldwater, OH (US)

(72) Inventor: Eric Marvin, Valparaiso, IN (US)

(73) Assignee: Elakai Ltd., Coldwater, OH (US)

( * ) Notice: Subject to any disclaimer, the term of this patent is extended or adjusted under 35 U.S.C. 154(b) by 0 days.

(21) Appl. No.: 18/085,211

(22) Filed: Dec. 20, 2022

(65) Prior Publication Data

US 2023/0191219 A1 Jun. 22, 2023

Related U.S. Application Data

(60) Provisional application No. 63/291,746, filed on Dec. 20, 2021.

(51) Int. Cl.
*A63B 67/06* (2006.01)

(52) U.S. Cl.
CPC ..... *A63B 67/06* (2013.01)

(58) Field of Classification Search
CPC ..... A63B 67/06; A63B 2071/0694; A63B 2209/00; A63B 43/00; A63B 43/002; A63B 2037/082
USPC ..... D21/707, 301
See application file for complete search history.

(56) References Cited

U.S. PATENT DOCUMENTS 2,238,035 A 4/1941 Char
3,480,280 A * 11/1969 Gamertsfelder ..... A63B 67/06 473/594
4,805,918 A * 2/1989 Feinberg ..... A63F 9/10 273/157 R
4,927,160 A * 5/1990 Nichol ..... A63F 9/02 273/DIG. 26
8,277,344 B2 * 10/2012 Cea ..... A63B 67/06 473/570
8,807,569 B1 * 8/2014 Davis ..... F41J 5/20 473/570
9,833,682 B1 12/2017 Morgan et al.
10,953,295 B2 3/2021 Modlin
D967,309 S * 10/2022 Berghash ..... D21/710
11,547,915 B1 * 1/2023 Reynolds ..... A63B 67/06
D998,733 S * 9/2023 Navarro ..... D21/301
2001/0036877 A1 * 11/2001 Hartman ..... A63B 69/00 473/588

(Continued)

FOREIGN PATENT DOCUMENTS

WO WO-2013006940 A1 * 1/2013 ..... A63B 43/00

OTHER PUBLICATIONS

"Slick Woody's", Aug. 30, 2016, <www.slickwoodys.com/blogs/cornhole-boards/what-are-cornhole-bags-made-of-fabric-types-and-corn-vs-resin-fill>, retrieved on May 17, 2024. (Year: 2016).*

(Continued)

*Primary Examiner* — Steven B Wong
(74) *Attorney, Agent, or Firm* — Dorton & Willis, LLP

(57) ABSTRACT

A bag for a bag toss game includes a first panel, a second panel opposite the first panel, and at least one gusset panel disposed between the first and second panels. The first and second panels joined to at least a part of the at least one gusset panel, proximate respective peripheral edges, to define an enclosed receptacle, and a fill material sealed within the receptacle. In another aspect, the gusset panel, in a filled condition of the bag, is arranged substantially perpendicular to at least one of the first panel or the second panel.

12 Claims, 2 Drawing Sheets

(56) References Cited

U.S. PATENT DOCUMENTS

| | | | | |
|---|---|---|---|---|
| 2005/0130775 | A1* | 6/2005 | Hylak | A63B 67/04 473/588 |
| 2006/0038341 | A1* | 2/2006 | Konstant | A63B 67/06 273/348 |
| 2009/0062093 | A1 | 3/2009 | Clark | |
| 2017/0231410 | A1 | 8/2017 | Chon et al. | |
| 2017/0232307 | A1* | 8/2017 | Weilong | F21V 23/02 473/570 |
| 2017/0312587 | A1* | 11/2017 | Goldwitz | A63B 69/0024 |
| 2019/0344142 | A1* | 11/2019 | Modlin | A63B 67/06 |
| 2019/0378425 | A1* | 12/2019 | Buehler | G09B 5/00 |
| 2020/0338418 | A1* | 10/2020 | Basque | A63B 67/002 |
| 2021/0023428 | A1* | 1/2021 | Falck | A63B 67/06 |
| 2023/0025001 | A1* | 1/2023 | Spillane | A63B 67/06 |
| 2023/0104523 | A1* | 4/2023 | Baxter | A63B 67/06 473/594 |
| 2023/0128677 | A1* | 4/2023 | Usher | A63B 67/06 473/594 |

OTHER PUBLICATIONS

"Cornhole Bag Fillers", Nov. 30, 2020, <https://plasticpellets4fun.com/blogs/pellet-technical-information/117769733-cornhole-bag-fillers>, retrieved on May 17, 2024. (Year: 2020).*

* cited by examiner

BAG TOSS GAME PROJECTILE BAG

CROSS-REFERENCE TO RELATED APPLICATIONS

This application claims the benefit of priority to U.S. Provisional Patent Application Ser. No. 63/291,746, filed Dec. 20, 2021 (pending), the disclosure of which is incorporated by reference herein in its entirety.

TECHNICAL FIELD

The present invention relates generally to games of skill and chance, and more particularly to a bag for use as a projectile in playing a bag toss game.

BACKGROUND

Target games that involve throwing a projectile toward a target are popular pastimes. A particularly popular target game that involves tossing bags filled with dried corn (or similar fill material) toward a target board to score points is commonly known as "cornhole." In variations of the cornhole bag toss game, players toss bags at target boards comprising an inclined top surface having a target hole of approximately six inches in diameter located near a far-end of the board. Points are scored by landing bags on the target board or, preferably, through the target hole. Defensive strategies for playing conventional cornhole games include blocking opposing players' bags from entering the target hole. Offensive strategies may include knocking an opposing player's bag off of the board.

To complement player skill, efforts have been made to develop bags having configurations that offer players the ability to more predictably land bags on the target board, or to perform various offensive or defensive strategies. Accordingly, there is a need for an improved cornhole bag that enables players to better utilize offensive or defensive strategies, and to better control behavior of the bag during play.

SUMMARY

The present invention provides an improved bag for playing a bag toss game, particularly cornhole, and which provides better control during game play. In one aspect, a bag for a bag toss game includes a first panel, a second panel opposite the first panel, and at least one gusset panel disposed between the first and second panels. The first and second panels joined to at least a part of the at least one gusset panel, proximate respective peripheral edges, to define an enclosed receptacle, and a fill material sealed within the receptacle. In another aspect, the gusset panel, in a filled condition of the bag, is arranged substantially perpendicular to at least one of the first panel or the second panel.

In exemplary embodiments, the material of at least one of the first panel, the second panel, or the at least one gusset panel may be the same or different from the material of any of the other panels. Advantageously, the material of the first panel, the second panel, or the at least one gusset panel may be selected such that the bag exhibits desired characteristics during game play. Moreover, the construction of the bag, particularly the gusset panel, provides improved performance characteristics and allows players to more effectively control behaviors of the bag during play.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate exemplary embodiments of the invention and, together with a general description of the invention given above, and the detailed description given below, serve to explain the principles of the invention.

DETAILED DESCRIPTION

Figure 1:
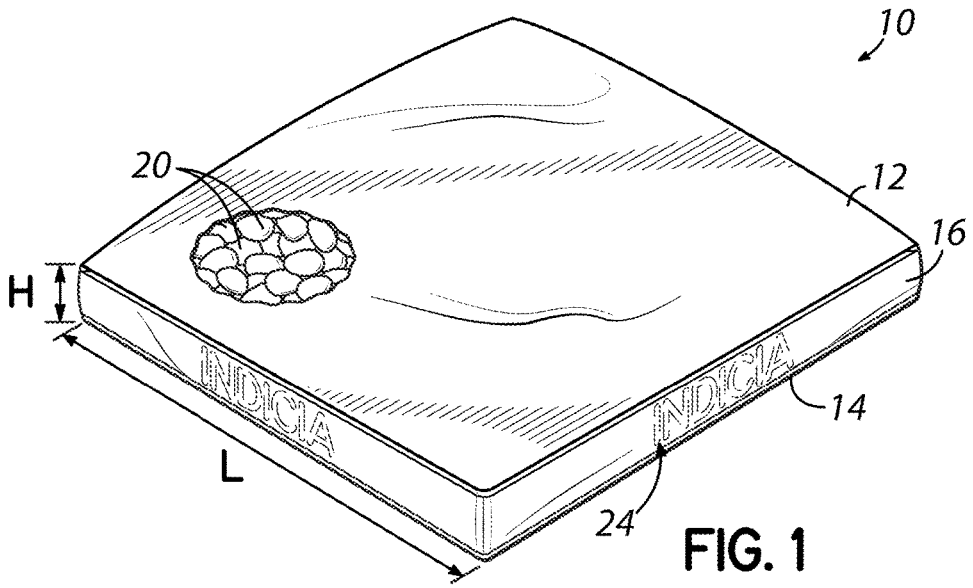
FIG. 1 is a perspective view of an exemplary projectile/bag for use in playing bag toss games in accordance with the principles of the present disclosure.

FIG. 1 depicts an exemplary projectile, or bag 10, for use in playing a bag toss game such as cornhole, in accordance with the principles of the present disclosure. The bag 10 is sized and shaped to facilitate tossing the bag 10 by hand toward a target board (not shown), and so that that bag 10 can be received through an approximately six-inch diameter target hole typical of conventional target boards used for playing cornhole. In a particular embodiment, the exemplary bag 10 has a generally square shape with a length L of about 6 inches along the sides, and a height H of about 1.5 inches. In the embodiment shown, the bag 10 includes first and second oppositely disposed panels 12, 14 and at least one third panel, or gusset panel, 16 disposed between the first and second panels 12, 14. The first and second panels 12, 14 are joined to at least part of the gusset panel 16, proximate the respective peripheral edges of the first and second panels 12, 14, to thereby define an enclosed receptacle 18.

The first, second, and gusset panels 12, 14, 16 may be formed, in whole or in part, from pliable materials, such as textile material, leather, plastic, or any other suitable natural or man-made material. In some embodiments, the bag 10 may be formed by joining the first, second, and gusset panels 12, 14, 16 proximate their respective peripheral edges, such as by stitching or sewing the panels together. In some embodiments, the first, second, and gusset panels 12, 14, 16 may be joined together while the first, second, and gusset panels 12, 14, 16 are arranged together such that the assembled panels are in an "inside-out" configuration, whereafter the assembled bag 10 may be inverted so that the desired faces of the joined panels are positioned on the outside of the bag 10. Typically, the first, second, and gusset panels 12, 14, 16 may be substantially joined together, and a small length of adjacent panels may be left unstitched to thereby create an opening that facilitates filling the receptacle 18 with a suitable fill material 20. Thereafter, the opening may be joined to fully secure the fill material 20 within the enclosed receptacle 18.

The first, second, and gusset panels 12, 14, 16 may be formed from the same material, or different materials may be selectively used for any panel and in various combinations as may be desired. Advantageously, the material of the first, second, and gusset panels 12, 14, 16 may be selected to cause the bag 10 to exhibit different playing characteristics.

As non-limiting examples, the material of the first and second panels 12, 14 may both be selected to provide a relatively low effective friction characteristic between the first and second panels 12, 14 and the playing surface 22 of a target board, whereby the bag 10 exhibits a higher tendency to slide upon landing on the playing surface 22. In another configuration, the material of the first and second panels 12, 14 may both be selected to provide a relatively high effective friction characteristic between the first and second panels 12, 14 and the playing surface 22 of the target board, whereby the bag 10 exhibits a greater resistance to sliding along the playing surface 22.

In yet another configuration, the first panel 12 may be formed from a material providing a relatively low effective friction characteristic with respect to the playing surface 22, while the second panel 14 may be formed from a material providing a relatively high effective friction characteristic. With such a construction, a player may choose whether to cause the bag 10 to slide or to resist sliding, depending upon whether the bag 10 is tossed to land with the first or second panel 12, 14 facing the playing surface 22. The material of the gusset panel 16 may also be selected to be the same or different from one or both of the first and second panels 12, 14. In one embodiment, the material of the gusset panel 16 includes indicia 24, such as text or graphics. Due to the generally flat surface area of the gusset panel 16, any indicia 24 provided on the gusset panel 16 may be more easily visible when the bag 10 is resting on a surface, such as the playing surface 22 of a target board.

In the embodiment shown and described herein, the first and second panels 12, 14 are formed from generally square shapes of material, and the gusset panel 16 comprises one or more elongate strips of generally rectangular-shaped material. It will be appreciated, however, that various other shapes may be used, such as round, triangular, hex, or any other desired shape to form a bag in accordance with the principles of the present disclosure. The gusset panel 16 may comprise a single, elongate strip of material that extends around the periphery of the first and second panels 12, 14, or the gusset panel 16 may comprise several individual lengths of gusset panel members that are joined between the first and second panels 12, 14. The fill material 20 may comprise corn, dried beans, stones, plastic pellets, or any other suitable material or combination thereof, to give weight and/or structure to the filled bag 10 for use as a projectile in a bag toss game.

In the filled condition of the bag 10, the gusset panel 16 is arranged substantially perpendicular to at least one of the first or second panels 12, 14, as generally shown in FIGS. 1-4. It will be appreciated that the gusset panels 16 may not be perfectly perpendicular to the first or second panels 12, 14, due to various factors such as the flexibility of the materials used for the first, second, or gusset panels 12, 14, 16; the amount of fill material 20 included in the receptacle 18; or shifting of the fill material 20 within the receptacle 18, however, the gusset panel 16 will generally be perpendicular to the first or second panels 12, 14 within a relative degree of offset in view of these factors. Advantageously, the particular construction of the exemplary bag 10 enables players to more effectively accomplish offensive and defensive strategies during game play.

Figure 2:
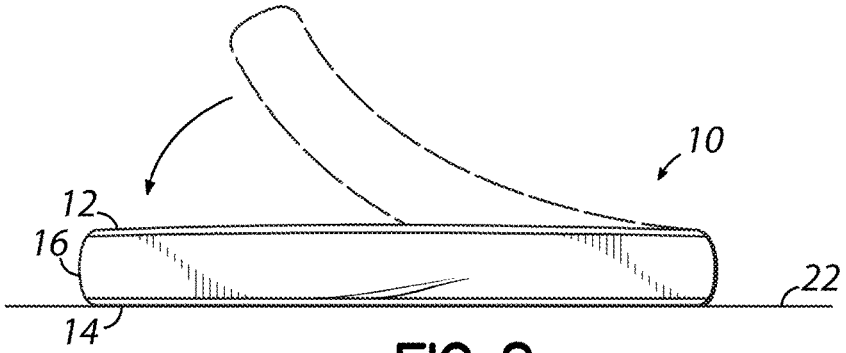
FIG. 2 is an elevation view of the exemplary bag of FIG. 1, illustrating characteristics of the bag.
Figure 3A:
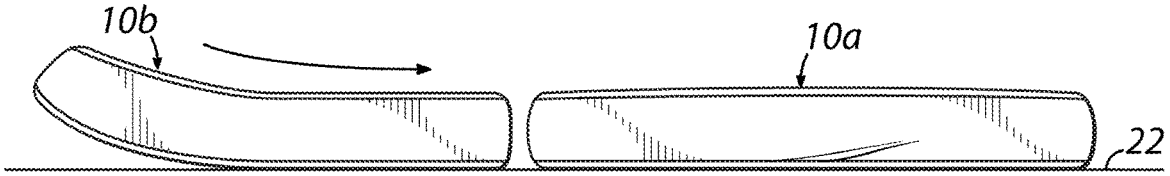
FIGS. 3A-3B schematically illustrate use of the bag of FIG. 1 to push or block another bag.
Figure 3B:
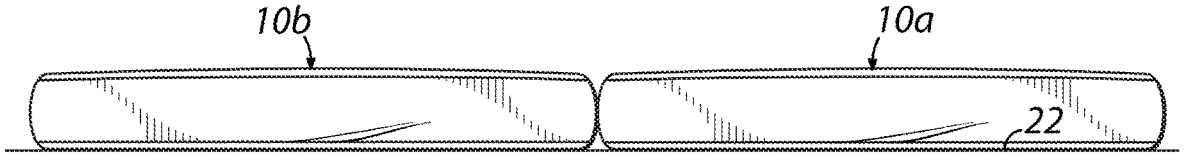
Figure 4:
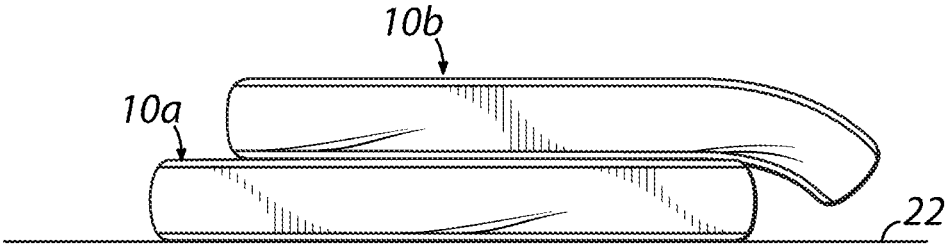
FIG. 4 schematically illustrates use of the bag of FIG. 1 to achieve a stacking configuration.

Referring now to FIGS. 2-4, use of a bag 10 in accordance with the principles of the present disclosure will be described. FIG. 2 illustrates how the construction of the exemplary bag 10 allows the first or second panels 12, 14 to lay as flat as possible when the bag 10 lands on the playing surface 22 of a target board, to thereby to allow players to have more control over placement of the bag 10 on the target board. In particular, the generally flat edges of the gusset panel 16 bias the bag 10 toward a substantially flat configuration when the bag lands on the playing surface 22, whereby the gusset panel 16 and the amount of fill material 20 within the receptacle 18 inhibit "rolling" of the bag 10 in instances when the bag 10 does not initially land on the playing surface 22 with substantially the entire portion of the first or second panels 12, 14 contacting the playing surface 22. Accordingly, when a tossed bag 10 lands on the target board with the first or second panel 12, 14 forming an angle to the playing surface 22, an effective flexural rigidity of the bag 10 biases any raised edge of the bag 10 in a direction toward the playing surface 22, as generally depicted in FIG. 2. This resistance to rolling inhibits tumbling of the bag 10 after the bag 10 lands on the playing surface 22, and allows players to more effectively utilize the surfaces of the first or second panels 12, 14 to slide or, alternatively, resist sliding of the bag 10 on the playing surface 22, depending on the friction characteristics of the material of the first and second panels 12, 14.

Referring now to FIGS. 3A-3B, use of the exemplary bag 10 to block or push other bags on the playing surface will be described. In FIG. 3A, a first bag 10*a* is already positioned on the playing surface 22 after having been thrown by a player, or alternatively his opponent. Due to the construction of the exemplary bag 10, particularly the gusset panel 16, a larger lateral surface is presented to a second bag 10*b* which may be thrown by an opposing player. As the second bag 10*b* lands on the playing surface 22 and slides in a direction toward the first bag 10*a*, as depicted in FIG. 3A, the second bag 10*b* eventually impacts the first bag 10*a* whereby the relatively larger impact surface provided by the gusset panel 16 creates a more solid blocking surface that prevents the second bag 10*b* from rolling up and onto, or over, the first bag 10*a*. Alternatively, and depending on the relative friction characteristics of the first and second bags 10*a*, 10*b*, the second bag 10*b* may be tossed with sufficient forward momentum that the second bag 10*b* pushes an opposing player's first bag 10*a* out of the way or off the board. Similarly, as an offensive strategy, a player's second bag 10*b* may be used to push the player's own first bag 10*a* into the target hole. In either case, the enlarged impact area provided by the gusset panel 16 ensures a larger surface for increased contact between the first and second bags 10*a*, 10*b*.

Referring now to FIG. 4, use of the exemplary bag 10 in a stacking maneuver is illustrated. In the embodiment shown, a first bag 10*a* may be tossed onto the playing surface 22, whereafter a second bag 10*b* may be tossed such that it lands generally atop the first bag 10*a*. The unique construction of the exemplary bag 10, particularly the gusset panel 16, allows the second and subsequent bags to stack atop the first bag 10*a* with more stability and less likelihood of rolling off one another compared to conventional bags. Stacking is another defensive strategy which may be utilized to prevent opponents from tossing their bags onto desired portions of the playing surface or through the target hole.

While the present invention has been illustrated by a description of various embodiments, and while these embodiments have been described in considerable detail, it is not intended to restrict or in any way limit the scope of the appended claims to such de-tail. The various features shown and described herein may be used alone or in any combination. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit and scope of the general inventive concept.

What is claimed is:

1. A projectile bag for a bag toss game, the bag comprising:

a first panel;

a second panel opposite the first panel;

at least one gusset panel disposed between the first and second panels;

the first and second panels joined to at least a part of the at least one gusset panel, proximate respective peripheral edges, to define an enclosed receptacle; and a fill material sealed within the receptacle;

the bag constructed and arranged such that the gusset panel and fill material cooperate such that the bag exhibits an effective flexural rigidity that biases any raised edge of the bag in a direction toward a game board playing surface, without rolling or tumbling, when the bag lands on the playing surface with the first or second panel forming an angle to the playing surface after having been tossed from a distance with forward momentum;

wherein the material of the at least one gusset panel is different from the material of the first panel and the material of the second panel.

2. The bag of claim 1, wherein the gusset panel, in a filled condition of the bag, is arranged substantially perpendicular to at least one of the first panel or the second panel.

3. The bag of claim 1, wherein the material of the first panel is different from the material of the second panel.

4. The bag of claim 1, wherein the material of the first panel is the same as the material of the second panel.

5. The bag of claim 3, wherein the material of the entire first panel is different from the material of the entire second panel.

6. The bag of claim 5, wherein:

the material of the first panel facilitates sliding of the bag on a game surface; and the material of the second panel inhibits sliding of the bag on the game surface.

7. The bag of claim 4, wherein the material of the first panel and the second panel facilitates sliding of the bag on a game surface.

8. The bag of claim 1, wherein the first and second panels are joined to at least a part of the at least one gusset panel by machine or hand-stitched thread.

9. The bag of claim 1, wherein the at least one gusset panel is sized and arranged to receive indicia that is visible externally of the bag.

10. The bag of claim 1, wherein the first and second panels have square shapes.

11. The bag of claim 10, wherein the sides of the first and second panels are each 6 inches in length.

12. The bag of claim 9, further comprising visible indicia on the at least one gusset panel.

* * * * *